United States Patent [19]

Culver et al.

[11] Patent Number: 4,795,216

[45] Date of Patent: Jan. 3, 1989

[54] CHILD RETAINING BELT

[76] Inventors: Robert A. Culver; Cindy L. Culver, both of 22324 Hackney St., West Hills, Calif. 91304

[21] Appl. No.: 137,521

[22] Filed: Dec. 22, 1987

[51] Int. Cl.[4] ..... A47C 31/00

[52] U.S. Cl. ..... 297/467; 297/465

[58] Field of Search ..... 297/485, 467, 468, 464, 297/465

[56] References Cited

U.S. PATENT DOCUMENTS

| | | | |
|---|---|---|---|
| 1,205,384 | 11/1916 | Peck | 297/467 X |
| 2,451,007 | 10/1948 | White | 297/467 X |
| 2,652,183 | 9/1953 | Hlivka | 297/467 X |
| 2,888,063 | 5/1959 | Rose | 297/467 X |
| 3,612,605 | 10/1971 | Posey, Jr. | 297/485 X |
| 3,713,692 | 1/1973 | McCracken et al. | 297/467 |
| 3,992,057 | 11/1976 | Studebaker | 297/468 X |
| 4,170,991 | 10/1979 | Kella | 297/467 X |
| 4,235,474 | 11/1980 | Rosenberg | 297/465 |
| 4,637,622 | 1/1987 | Burgard | 297/485 X |
| 4,676,554 | 6/1987 | Harlick et al. | 297/467 |

*Primary Examiner*—Peter A. Aschenbrenner
*Assistant Examiner*—Thomas A. Rendos
*Attorney, Agent, or Firm*—Allan M. Shapiro

[57] ABSTRACT

Child-retaining belt comprises first and second flexible bands which are secured together adjacent the mid-section of each at an angle with respect to each other. Fastening devices are secured to the bands at all four ends thereof so that the crossing point of the bands can be placed in a chair, with the rearward pair of band ends attached behind the chair. The child is placed upon the crossing point, and the forward pair of band ends is brought up around the child's waist and back around the chair to be fastened together, thus retaining the child.

5 Claims, 1 Drawing Sheet

FIG. 1
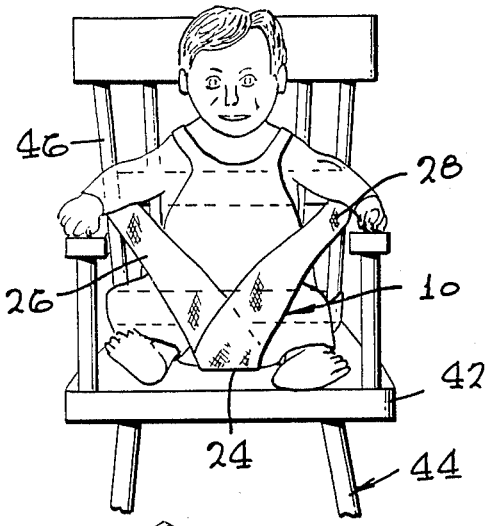
FIG. 2
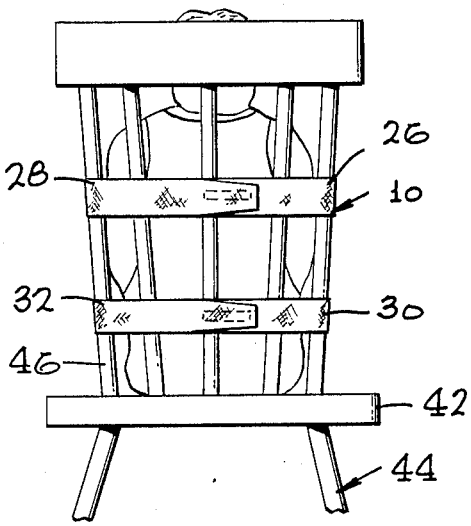
FIG. 3
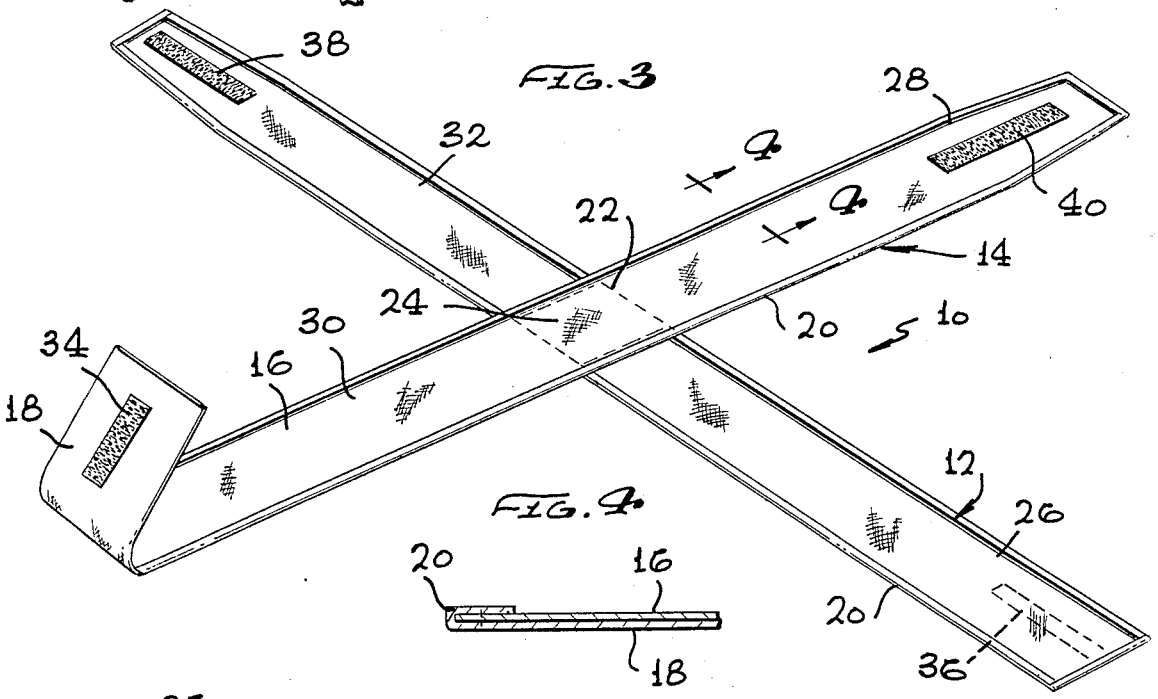
FIG. 4
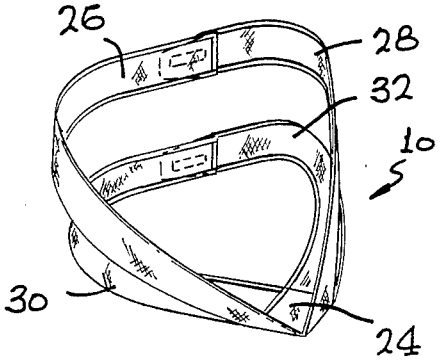
FIG. 5
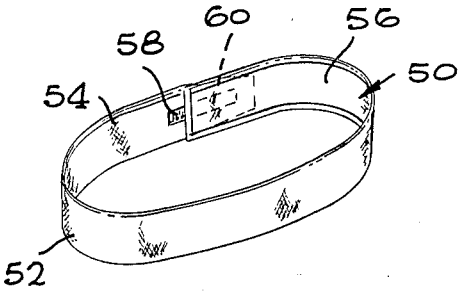
FIG. 6

CHILD RETAINING BELT

FIELD OF THE INVENTION

This invention is directed to a child-retaining belt to aid in the detention of a child in a chair. The term "chair" includes any seating device having a seat and a back.

BACKGROUND OF THE INVENTION

Children tend to be active and do not remain in their chairs, as is sometimes required by polite society. These are chairs particularly designed for small children for when they are to be fed. These chairs have a restraining device so that the child cannot leave the chair and possibly fall. The custodian of the child wants to retain the child until the feeding period has been completed. These specific chairs are generally designated as high chairs. High chairs normally have a sliding tray thereon, and it is the tray which performs a major part of the child-retaining function. If straps are used, the straps extend down from the tray to the chair seat so that the child cannot squirm down under the tray to leave the high chair. However, outside of the child-feeding period, there is often need for retaining a child in a chair. This is both to retain the child in the upright position so he does not slide down in his chair and to prevent the child from leaving the chair. Retaining the child in the chair is often helpful so that his location is known and he is kept out of trouble.

SUMMARY OF THE INVENTION

In order to aid in the understanding of this invention, it can be stated in essentially summary form that it is directed to a child-retaining belt wherein first and second flexible bands are attached together adjacent their mid-points, and at the ends, carry further attachment means thereon so that the bands can embrace a child and be attached together behind a chair.

It is thus an object and advantage of this invention to provide a child-retaining belt which can embrace a child and attach to a chair to retain the child within the chair.

It is another object and advantage of this invention to provide a child-retaining belt wherein first and second flexible bands are attached together and have attachment means thereon so that the retaining belt can be used with different sizes of children and different sizes of chairs to retain the child with respect to the chair.

It is another object and advantage of this invention to provide a child-retaining belt wherein the child-retaining belt can be engaged around both a child and a portion of the chair and there is detachable attachment means on the ends of bands of the retaining belt with the detachable attachment means being of such nature that the bands can be attached together at different locations to secure and retain the child within the chair.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a front elevational view of a child retained in a chair by employment of the child-retaining belt of this invention.

FIG. 2 is a rear elevational view thereof.

FIG. 3 is an enlarged isometric view of the child-retaining belt of this invention.

FIG. 4 is a further enlarged section taken generally along the line 4—4 of FIG. 3, with parts broken away.

FIG. 5 is an isometric view of the child-retaining belt of this invention configured as it is positioned when retaining a child.

FIG. 6 is an isometric view of a second preferred embodiment of a child-retaining belt in accordance with this invention.

DESCRIPTION OF THE PREFERRED EMBODIMENTS

The first preferred embodiment of the child-retaining belt of this invention is generally indicated at 10 in FIGS. 1, 2, 3 and 5. As is seen in FIG. 3, belt 10 is made up of two flexible bands 12 and 14. The flexible bands 12 and 14 are generally of elongated rectangular shape and may be made of flexible polymer composition material or flexible fabric. Flexible fabric is preferred because of its feel. Two layers of fabric may be employed, with an inside layer 16 and an outside layer 18, as indicated in FIGS. 3 and 4. The outside layer is larger and is folded over the edge of the inside layer to form hem 20, which is sewn through to provide a neat, finished appearance. Both flexible bands are of the same construction. The use of two fabric layers is desirable so that the layers can have different decor. The inner fabric layer may be the strength layer, while the outside fabric layer is the appearance layer. As is seen in FIG. 3, each of the flexible bands is an elongated, rectangular band which may be tapered at one or both ends.

The two flexible bands are attached together and are preferably permanently secured together. The bands are attached so that they lie at substantially right angles with respect to each other. The angle between the bands is preferably between 60 degrees and 90 degrees. Attachment is preferably by sewing, such as along the hem lines shown in FIG. 3, one of which is indicated at 22. The attachment area is generally indicated at 24. The attachment of the two flexible bands together thus defines four arms 26, 28, 30 and 32 extending outward from the attachment area. The ends of these arms are to be detachably attached together. To accomplish this, various types of attachment means can be employed. The preferable attachment means are resilient hook and loop fasteners of the type sold under the trademark "Velcro". Attachment strips 34 and 36 of one hook or loop type are attached respectively to arms 26 and 30 and attachment strips 40 and 38 of the second hook or loop type are attached to arms 28 and 32. It is seen in FIG. 3 that, when the child-retaining belt is lying flat, the attachment strips 34 and 36 of the first type are on the under surfaces of the arms and the attachment strips 38 and 40 of the second type are on the upper surfaces of the arms. This permits the opposite arms to be brought together, overlapped and attached.

The belt 10 is laid on the seat 42 of chair 44 with the attachment area pretty well towards the back of the chair and with the rearward arms 30 and 32 extending back off of the seat of the chair. The arms and the back may be brought together back around the back 46 of the chair and attached. The child is placed in the chair towards the back thereof, mostly sitting on the attachment area 24. Thereupon, the forward arms 26 and 28 are brought up over his legs and back around his sides, under his arms and engaged around the back of the chair. The arms of the belt are overlapped and attached at a selected, firm, but not tight position behind the chair. In this way, the child is retained in the chair. Complete adjustability is achieved for children and chairs of different sizes, by virtue of the Velcro attachment of the arms.

It is seen that the belt 10 does not provide appreciable support for the child. It simply engages beneath him and then up between his legs and back around his waist to hold the bottom portion of his torso back in the chair. This properly retains the child who is capable of pulling up, but for those children who are smaller and do not sit up strongly, it provides inadequate support under the armpits. For this reason, belt 50 is provided as a substitute for or in addition to the belt 10. Belt 50 is a felxible band 52 of inner and outer layers of fabric, hemmed together. The belt 50 has arms 54 and 56 which form the ends of the flexible band. These arms carry detachable adjustable attachment means thereon, such as hook or loop attachment strips 58 and 60. The belt 50 is an elongated, rectangular belt which is engaged around the chest and under the arms of the infant and around the adjacent back of the chair to hold the infant back against the back of the chair to prevent him from slumping over and perhaps toppling. Thus, the belt 50 can be used to support a smaller child, alternatively to or in addition to the retaining belt 10.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A child-retaining belt consisting of:

a first flexible fabric band of substantially rectangular shape, said first band having ends and said ends being first and fourth arms, said first band having a mid-point between its ends, said first band having first and second sides;

a second flexible fabric band of substantially rectangular shape, said second band having ends, said ends being second and third arms, said second band having a mid-point between its ends, said second band having first and second sides;

said first and second bands lying with their midpoints together with said first side of said first band lying against said second side of said second band with an open angle between said arms, with their mid-points being secured together;

hook and loop attachment means wherein resilient hooks can engage in loops for attachment and for detachment, said hook attachment means being secured to a first arm of said first band on said second side thereof and said loop attachment means being secured to said fourth arm of said first band on said first side thereof so that said arms of said first band may be detachably attached to each other;

hook attachment means being secured to said second band on the second arm thereof on the first side thereof and said loop attachment means is secured to said third arm of said second band on said second side thereof so that said arms of said second band can be detachably secured together so that said belt can be placed on a chair having a back with said mid-point of said first and second bands on the seat of the chair with the fourth arm of said first band and third arm of said second band extending around the back of the chair and attached together by means of said detachable hook and loop attachment means and said first arm of said first band and second arm of said second band each extend over one of the legs of the child retained by said belt and said arms extend back around the back of the chair and are attached to each other by means of said detachable hook and loop attachment means so as to engage a child and detachably retain a child with respect to the chair.

2. The child-retaining belt of claim 1 wherein said flexible bands are formed of an inside flexible fabric layer and an outside flexible fabric layer, said outside flexible fabric layer being folded around the outer edge of said inside flexible fabric layer and being seamed thereto.

3. The child-retaining belt of claim 2 wherein said flexible bands are formed of textile fabric and said bands are sewn together at said attachment area to permanently attach said bands and define said arms.

4. A child-retaining belt consisting of:

first and second flexible bands, said first and second flexible bands each being substantially rectangular and being of greater length than width, said first flexible band having ends which form first and fourth arms, said second flexible bands having ends which form second and third arms, both of said first and second flexible bands being formed of an inside flexible fabric layer and an outside flexible fabric layer, said outside flexible fabric layer being folded around the outer edge of said inside flexible fabric layer and being seamed thereto;

said first and second flexible fabric bands lying against each other substantially at their center points between their ends so as to define an open angle with respect to each other, said first and second flexible bands being sewn together where they overlie each other adjacent their mid-points so as to be permanently attached;

hook and loop fastening means adjacent the ends of said arms for selective attachment and detachment of said hook and loop fastening means, said hook attachment means being positioned on the second side of said first and third arms and said loop attachment means being positioned on the first side of said second and fourth arms so that the mid-point of said bands can be placed in a chair having a back with said third and fourth arms extending around the back of the chair and attached together by means of said detachable hook and loop attachment means and said first and second arms can each extend over one of the legs of the child retained by said belt and extend back around the back of the chair and be attached to each other by said detachable hook and loop attachment means so as to engage a child and detachably retain a child with respect to the chair.

5. The child-retaining belt of claim 4 wherein the angle between two adjacent of said arms is between 60 degrees and 90 degrees.

* * * * *